US011859949B1

(12) United States Patent
Choiniere et al.

(10) Patent No.: US 11,859,949 B1
(45) **Date of Patent: *Jan. 2, 2024**

(54) GRID MUNITION PATTERN UTILIZING ORTHOGONAL INTERFEROMETRY REFERENCE FRAME AND RANGE RADIO FREQUENCY CODE DETERMINATION

(71) Applicant: BAE Systems Information and Electronic Systems Integration Inc., Nashua, NH (US)

(72) Inventors: Michael J. Choiniere, Merrimack, NH (US); Ira B. Ekhaus, Arlington, MA (US); Quang M. Lam, Fairfax, VA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 985 days.

This patent is subject to a terminal disclaimer.

(21) Appl. No.: 16/587,564

(22) Filed: Sep. 30, 2019

Related U.S. Application Data

(60) Provisional application No. 62/738,054, filed on Sep. 28, 2018.

(51) Int. Cl.
*F41G 7/28* (2006.01)
*F41G 7/00* (2006.01)
*F41G 7/22* (2006.01)

(52) U.S. Cl.
CPC ..... *F41G 7/28* (2013.01); *F41G 7/008* (2013.01); *F41G 7/226* (2013.01)

(58) Field of Classification Search
CPC ..... F41G 7/28; F41G 7/008
See application file for complete search history.

(56) References Cited

U.S. PATENT DOCUMENTS

| | | | | |
|---|---|---|---|---|
| 5,435,503 | A * | 7/1995 | Johnson, Jr. | F41G 7/2246 701/3 |
| 5,917,442 | A * | 6/1999 | Manoogian | F41G 7/008 342/75 |
| 8,120,526 | B2 | 2/2012 | Holder | |
| 8,854,252 | B2 | 10/2014 | Holder | |
| 9,401,741 | B2 | 7/2016 | Holder et al. | |
| 9,696,418 | B2 | 7/2017 | Holder | |
| 10,012,477 | B1 * | 7/2018 | Ell | F41G 7/2253 |
| 11,199,380 | B1 * | 12/2021 | Ekhaus | F41G 7/226 |
| 2010/0295720 | A1 * | 11/2010 | Rastegar | F41G 7/28 342/62 |
| 2012/0169524 | A1 * | 7/2012 | Yeary | G01S 5/10 342/62 |
| 2016/0003579 | A1 * | 1/2016 | Stansfield | G01S 7/4004 244/3.19 |

(Continued)

FOREIGN PATENT DOCUMENTS

WO 2007/016098 A2 2/2007

*Primary Examiner* — Marcus E Windrich
(74) *Attorney, Agent, or Firm* — Scott J. Asmus

(57) ABSTRACT

The system and method of projectile flight management using a combination of radio frequency orthogonal interferometry for the long range navigation and guidance of one or more projectiles that does not need to be accurate all the way to the ground based on the use of larger artillery. The system provides for more accurate targeting, especially in GPS-denied and GPS-limited environments.

15 Claims, 10 Drawing Sheets

(56) References Cited

U.S. PATENT DOCUMENTS

| | | | | |
|---|---|---|---|---|
| 2016/0084623 | A1* | 3/2016 | Facciano | H01Q 1/42<br>342/372 |
| 2016/0273880 | A1* | 9/2016 | Dryer | F42C 13/04 |
| 2016/0349026 | A1* | 12/2016 | Fairfax | F42B 10/26 |
| 2017/0268852 | A1* | 9/2017 | Kuhn | F41G 7/008 |
| 2017/0314892 | A1* | 11/2017 | Holder | G01S 13/42 |

* cited by examiner

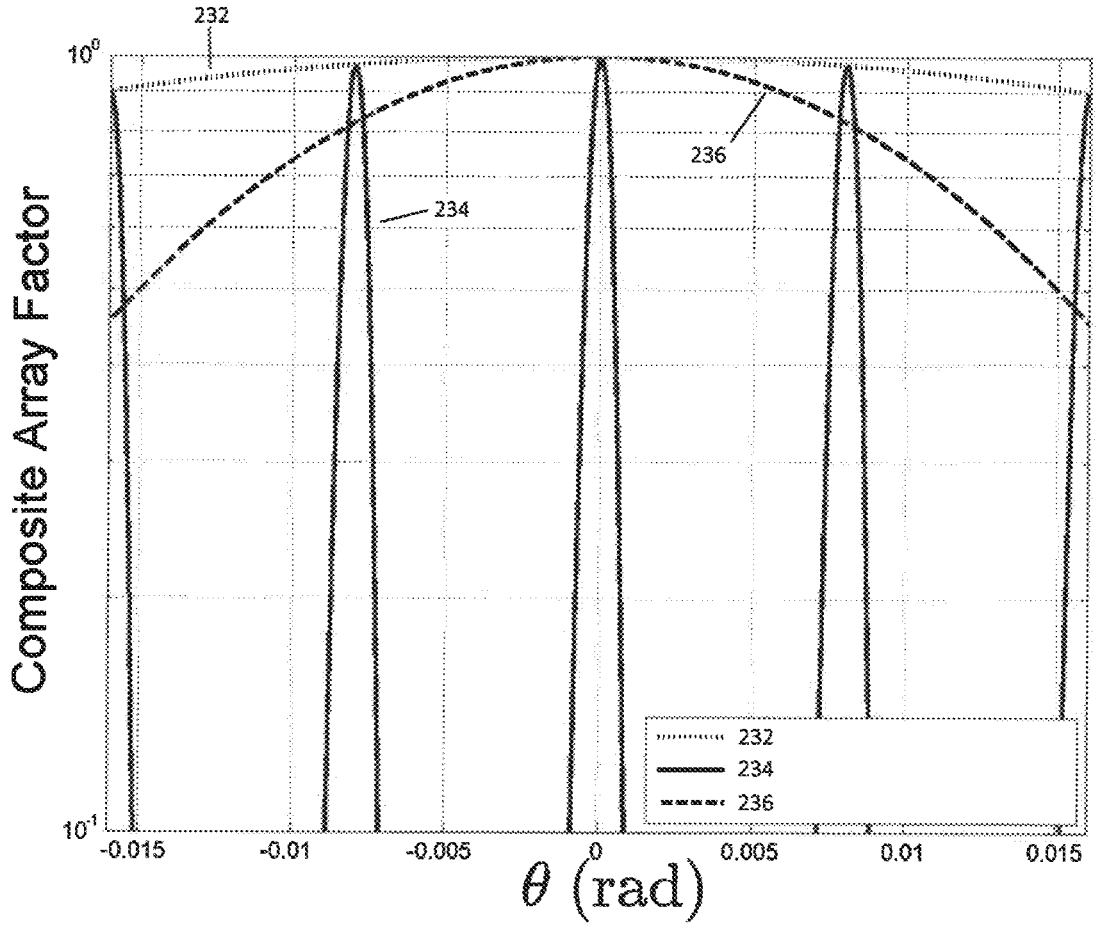
FIG 2.E

GRID MUNITION PATTERN UTILIZING ORTHOGONAL INTERFEROMETRY REFERENCE FRAME AND RANGE RADIO FREQUENCY CODE DETERMINATION

CROSS REFERENCE TO RELATED APPLICATIONS

This application claims priority to U.S. Provisional Patent Application No. 62/738,054, filed Sep. 28, 2018, the content of which is incorporated by reference herein its entirety.

FIELD OF THE DISCLOSURE

The present disclosure generally relates to accurately guiding projectiles and more particularly to guiding projectiles in GPS-denied or GPS-limited environments using at least partially radio frequency (RF)/orthogonal interferometry (OI) techniques.

BACKGROUND

The dominant approach currently used for guiding a weapon, projectile, UAV, or other similar asset is the global positioning system (GPS). The weapon, projectile, UAV, or the like measures its earth position in latitude, longitude, and altitude, to calculate and execute a trajectory towards a GPS located target. This approach has been in use for many years but is now becoming vulnerable to GPS jamming, both denied and spoofing. Other techniques to extend the GPS approach involve pseudolites, or pseudo-satellites, which are devices that are placed along the path to the target and which utilizes GPS-like transmissions to aid the navigation of the asset. One issue with this approach is the delivery/placement of the pseudolites along the path to the target. The risk to the installer is high given these pseudolites are typically in hostile regions and they are also susceptible to jamming since they are analogous to systems using GPS waveforms. Other pseudolite deployments utilize air platforms, which complicate the engagement logistically.

Wherefore it is an object of the present disclosure to overcome the above-mentioned shortcomings and drawbacks associated with conventional projectile guidance systems especially in GPS-denied and GPS-limited environments.

SUMMARY

It has been recognized that there is a need to replace and/or supplement GPS navigation with a new, jam resistant guidance system for success in today's tactical environment. One aspect of the present disclosure is a navigation method within a GPS-denied or a GPS-limited environment that utilizes a local domain RF illuminator for weapon, projectile, UAV, or other asset guidance that can be deployed away from the engagement area. In certain embodiments, the RF system provides GPS navigation-like performance, but is resistant to jamming.

One aspect of the present disclosure is a flight management system, comprising: at least one air-borne device directed toward at least one target; a radio frequency orthogonal interferometry array being aligned via a north finding device, the radio frequency orthogonal interferometry array providing a reference frame, via a projected grid, in the direction of the at least one target; the reference frame providing azimuth and elevation information for use in guidance of the at least one air-borne device from a distance from the at least one target to a transition point, wherein the radio frequency orthogonal interferometry array has an accuracy; and the reference frame providing azimuth and elevation information for use in tracking the at least one target, wherein the radio frequency orthogonal interferometry array provides for controlled detonation of the at least one air-borne devices after a transition point to ballistic guidance.

One embodiment of the flight management system is wherein the controlled detonation of the at least one air-borne devices is used in area suppression where a plurality of air-borne devices are detonated in a grid pattern in an area where a plurality of targets are present.

Another embodiment of the flight management system is wherein the distance from the target is about 100 km and the transition point is less than about 10 km. In some cases, the transition point is from about 3 km to about 1 km Yet another embodiment of the flight management system is wherein each of the plurality of air-borne devices is sequentially transitioned from the reference frame to a glide slope as a cascade of events.

Still yet another embodiment of the flight management system is wherein each of the plurality of air-borne devices is sequentially launched such that each of the plurality of air-borne devices may also be sequentially transitioned from the reference frame to a glide slope for controlled detonation of a single target, multiple targets, or to a grid pattern for effective saturation of the target area.

Another aspect of the present disclosure is a method of guiding multiple assets towards at least one target, comprising: initiating, via a fire control system, a fire command for multiple assets; loading and firing the multiple assets; powering up a radio frequency orthogonal interferometry array; powering up the asset; receiving target locations and waveform mission codes via a communication link at each of the multiple assets; collecting, via an radio frequency receiver located on each of the assets, radio frequency waveforms from the radio frequency orthogonal interferometry array; determining azimuth, elevation, and range to target data for each of the multiple assets, via an on-board asset processor; calculating individual target navigation waypoints for each of the multiple assets via the on-board processor; and navigating each of the multiple targets to the one or more targets.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

FIG. 2E shows a zoomed in view of the product of the real beam pattern and electrically large interferometric ambiguity of FIG. 2D.

DETAILED DESCRIPTION

In one embodiment of the system of the present disclosure, a Radio Frequency (RF) Orthogonal Interferometry (also referred to as Orthogonal Interferometer) (OI) illuminator or transmitter is located at some position from the weapon system (e.g., at 0 to 100 km) and an RF receiver is mounted on an asset and receives the OI waveforms (distinguishable waveforms referenced to respective phase centers) to determine azimuth and elevation and to receive range information from an RF communications link in order to guide the asset to a target. In some embodiments, the azimuth and elevation information has an accuracy of about 100 to 300 μrads depending on the transmitter configuration. In some cases, the system range information has an accuracy of about +/−20 to 40 meters depending on various system operating parameters. In certain embodiments, the asset is given the target's location prior to launch or via RF or other communications link after launch within the RF/OI frame of reference. The asset in one example has on-board processing capability and calculates the trajectory for the target intercept using on-board guidance laws on and on-board processor.

The approach to local domain guidance control of the present disclosure allows the user to deploy an RF/OI illumination system anywhere in the world given the portability of the system (e.g., it fits on a small utility trailer), the system's range >100 km, and the system's accuracy. This system's performance is similar in some respects to the GPS systems, but has the added benefit of jam resistance due to features such as the use of custom coding of the RF/OI waveform, the illuminator's signal strength, the deployment geometry, and the antenna configurations. Unlike the GPS navigation waveforms which are published, the RF/OI illumination system would not be public. The system operator could select frequency, Pulse Repetition Interval (PRI) and pulse duration, and other parameters. For example, the control of the waveform properties including pulse width, frequency and/or frequency hopping are used by the illuminator to mitigate jamming. Assuming a 100 nanosecond pulse, frequency hopping with varying PRI could be utilized in a code format loaded prior to launch or during flight. In addition, the rearward looking antenna on the projectile provides receiver isolation from any jammers forward or below the projectile. The combination waveform control and antenna spatial selectivity provides counter measure immunity or mitigation. The RF/OI illumination system is also difficult to detect. As an example, ground based jammers have the additional burden of being direct line of sight of the RF/OI illuminator, thereby making detecting its presence difficult due to the curvature of the earth.

Figure 1A:
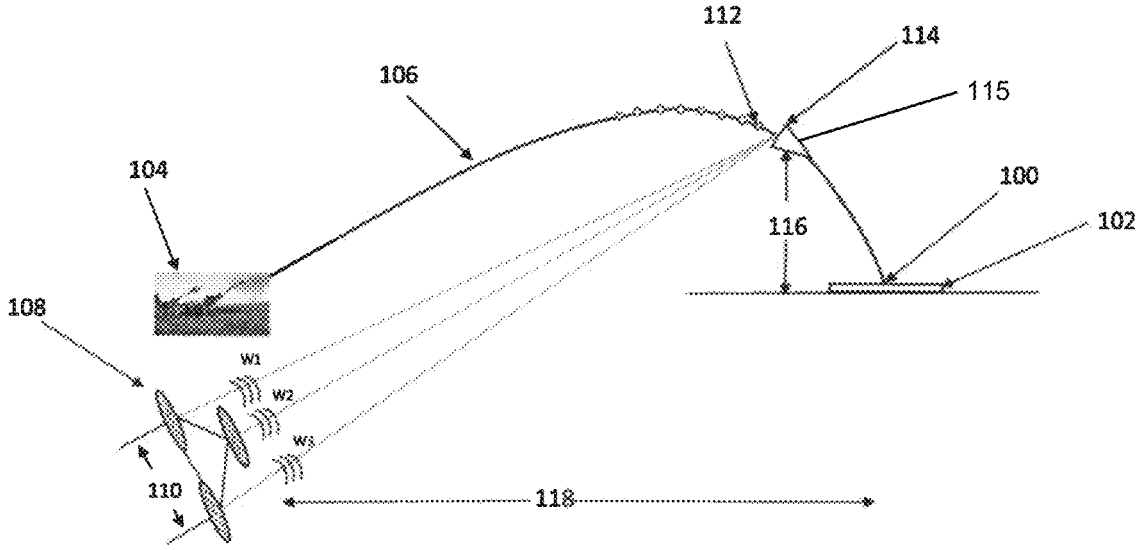
FIG. 1A is a diagram of one embodiment of the system of the present disclosure.

Referring to FIG. 1A, a diagram of one embodiment of the system of the present disclosure is shown. More specifically, at least one asset 115 is launched from a launch area 104 and the at least one asset 115 is directed at a target 100 some distance away 118 from the launch area 104. In some cases, the distance 118 is about 200 km. After launch, the asset 115 (e.g., munition, projectile, etc.) travels along a trajectory 106 toward the target 100. A circular error probable (CEP-50) 102 is defined as a circular area having a radius that encompasses where 50% of the assets land. CEP-50 is a common measure of accuracy for ballistics. In certain embodiments of the system of the present disclosure, the CEP-50 102 is about 30 m. In some cases, the CEP-50 102 is limited by the performance of the air frame, its limited control authority, the asset's ability to perform high G maneuvers, and the like.

Still referring to FIG. 1A, a radio frequency (RF)/Orthogonal Interferometry (OI) illuminator 108 is used to guide the one or more assets to the target. In one embodiment, the RF array comprises three active electronically scanned array (AESA) panels 109, where an AESA is one type of phased array antenna that is computer-controlled. There, the RF waves may be electronically steered to point in different directions without physically moving the antenna such as by leveraging the many antenna elements in the array.

In some embodiments of the system of the present disclosure, the array panels can also move. In one embodiment, the RF array is compact, with dimensions 110 of about 1.5 m×1.5 m×0.75 m. The AESA panels 109 are typically located proximate each other with some separation. The number of panels can vary depending upon the desired accuracy and redundancy.

In some embodiments, the RF array 108 guides (and tracks if equipped with fire control system) the one or more assets 115 along the trajectory 106 with accuracy of about ±5 m range and ±10 m azimuth and elevation 112. In certain embodiments, the RF array uses orthogonal interferometry (OI) methods to project a reference frame, or a projected grid, which is analogous to a polar coordinate azimuth and elevation for the three dimensional space. The polar coordinates can be can be mapped to standard grid coordinates—latitude and longitude. In one example, the RF/OI illuminator system 108 produces a reference frame that is aligned using a north finding device such as a gyro, or the like, such that the one or more projectiles or assets 115 do not require separate north finding capabilities. In this case a single north finding device can be leveraged for multiple assets such as a swarm. The north finding device is intended to obtain a reference point for the further processing. This also tempers the need for precise alignment of the assets—center mass aiming—and thus, minimizes operator processing time and resources. In certain embodiments, the RF/OI system can provide 10°, 20°, or 30° fields of engagement. In some embodiments, the system provides for adjustable accuracy/guidance precision based, in part, on the RF/OI transmit power, antenna spacing, and deployment angle, where the cross range accuracy is equal to angular resolution times range. Thus the present system operates in GPS denied environments with minimal likelihood of being jammed or spoofed Additionally, the system of the present disclosure provides a means to precisely measure and subsequently correct trajectory variations due to the varying energetics and the cross wind impact of each of the one or more projectiles by maintaining the desired trajectory using the RF/OI system array as a stable and precise frame of reference for long range position and projectile guidance. This technique reduces the complexity and the cost of the control actuator system (CAS) by simplifying the components needed on the projectiles. The control actuation system in one example provide fins or canards with controllers that enable changes to the flight of the asset. In some cases, an RF receiver and RF apertures are present on each round. In some cases, by using the RF/OI system, no azimuth aiming is required and minimal elevation adjustment is needed for each projectile, thus allowing the flight navigation system to make the course corrections accounting for the range differential due to energetics and aiming errors. The projectile in one example is a small rocket or artillery round having a warhead, a fuse, a control actuation system, guidance and navigation system, and a rocket engine. The guidance and navigation section in one embodiment includes a rear facing antenna/aperture, RF receiver, control actuation system, and a short range guidance system. The short range guidance system detector can include at least one detector such as a semi-active laser seeker or imaging system. Alternatively, the short range guidance system can be an inertial measurement unit that provides orientation and enables the asset to continue its trajectory to the target.

In one embodiment of the system of the present disclosure, the RF/OI system 108 "hands off" the positioning and guidance of the one or more projectiles at a certain hand-off point 114. Hand off refers to a transition point from the use of the RF/OI guidance to a secondary form of guidance, to increase the accuracy of the projectile. In some cases, the hand-off point 114 is about 6 km to about 10 km from the target 100 along the flight path. In some cases, the hand-off point 114 is located a distance above a plane 116 within which the target is located. In some cases the distance 116 is about two km to about three km above the plane. In some cases, the target is on land. In some other cases the target is on the surface of water. The hand-off can be accomplished as a timed event starting from launch or the hand-off can be event driven. In certain embodiments, an event driven hand-off may be when a short range guidance system (e.g., a semi-active laser or image seeker) detects the target and initiates terminal guidance.

The navigation approach of the present disclosure can be adapted for airborne targets, such as UAVs in certain embodiments of the present disclosure. In some cases, the tracking system (e.g., EO/IR or RF—RADAR) on the ground provides target location updates to the airframe/weapon. The fire control system tracks the UAV, providing Azimuth, Elevation and range information in the RF/OI reference frame, which is uplinked to the guided projectile/weapon to complete the guidance loop. In one embodiment, the uplink can be accomplished by either an EO/IR or RF modality.

For an application of artillery firing as a grid pattern, to provide for maximum effect on a designated area, the system utilizes the RF/OI illuminator to fly about 95% of the flight path until Line of Sight (LOS) limitations necessitate a handoff to a terminal guidance system, due in part to multipath limitation of the RF/OI system, to flight ballistics. The RF/OI illuminator can be used to mitigate the wind and the energetics variability of launch that can affect the trajectory of a munition. The RF/OI system is used to determine a navigation correction, in part, to put the munition on the correct path to the target. In one embodiment, a pre-launch initiation would determine the impact point of the LOS limitation threshold and then the control features would be trimmed and flight ballistics would be used the last one to three km. The short ballistic flight incurs very little additional error since the heavy projectile (e.g., 30 to 65 lb.) reaches the ground in three to ten seconds and is hard for the cross winds to blow it off course in that limited time.

Figure 1B:
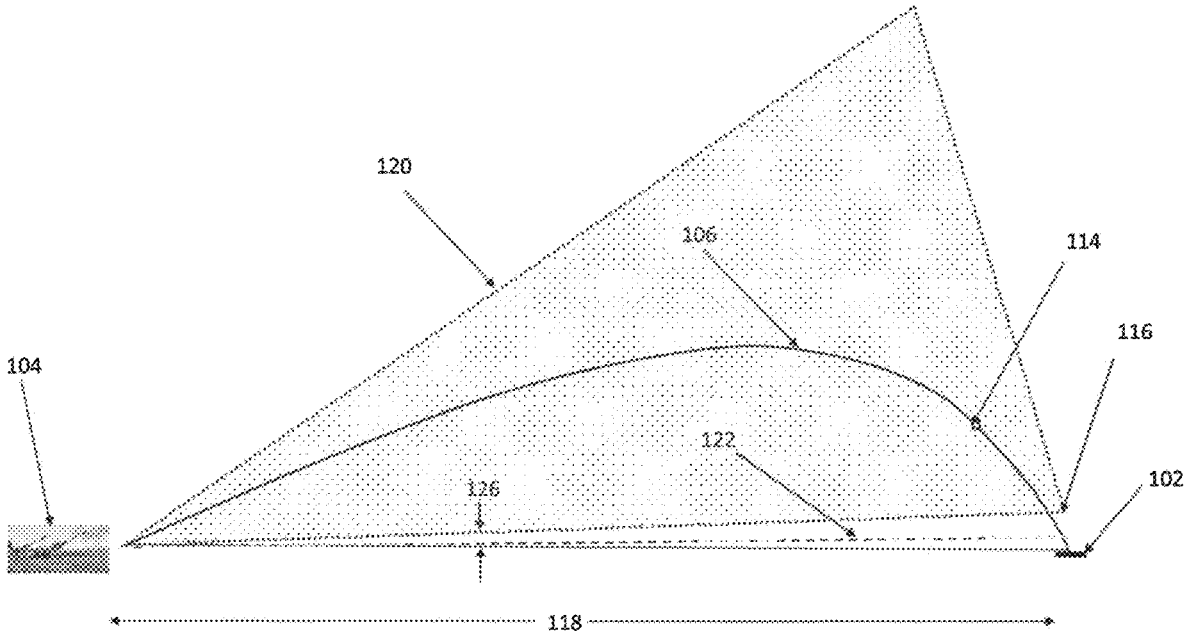
FIG. 1B is a diagram of one embodiment of the system of the present disclosure.

FIG. 1B depicts a diagram of one embodiment of the system of the present disclosure. More specifically, in this figure the RF/OI system is co-located with the launch point 104 for the one or more projectiles (one flight path is shown 106). In some cases, the RF/OI system is located well behind the launch point 104 to provide protection for the RF array. In some cases, the RF/OI system can be located a distance 118 from the target having a known CEP-50 102. In certain embodiments, the distance 118 is about 100 km and the CEP-50 102 is about 30 m. In contrast, a conventional radar system has range limitations for two-way radar, and may need to be forward deployed, thus placing radar in front of the launch area endangering the equipment by subjecting it to crossfire and or direct targeting by enemy forces.

As seen in FIG. 1B, the RF/OI system produces a RF reference frame 120. The munition trajectory 106 is located within that reference frame 120. The reference frame does not require active scanning and thus provides for simplified flight control management. The reference frame also provides for tracking of multiple rounds at the same time by projecting a grid in the air as a reference frame. The transition point 114, e.g., when the projectile begins a glide slope to the target, is also shown. In certain embodiments, RF communication links on each round allows for programming the trajectory during flight for each round. In some cases, the guidance for the asset begins at the moment of firing or early in the flight trajectory. With the present system, no pre-firing program or precise aiming of the weapon system is needed. Instead, guidance can be handled directly from a mission computer.

Still referring to FIG. 1B, the line of sight (LOS) 122 is limited over the distance 118 due to the curvature of the earth. In one embodiment, the distance above the plane of the target 116 for the LOS 122 is about 800 m. In certain embodiments, the distance above the plane of the target 116 for the base of the RF reference frame is about 1400 m, thus making the transition point 114 important for grid targeting. In some cases, a magnetometer inertial measurement unit (IMU) is also used to supplement the guidance of the one or more projectiles.

The LOS 122 prevents the weapon from seeing the RF/OI illuminator below the horizon. In addition, the RF/OI receiver's wave form is controlled to mitigate multipath due to the earth and influencing the accuracy of the position measurement. Waveforms allow multipath mitigation and allow the receiver to post process the impact of multipath out of the position results. These techniques yield a safe zone of navigation that corresponds to a slant angle of about one degree 126 from the RF/OI illuminator or a height restriction 116 which is range dependent.

Figure 2A:
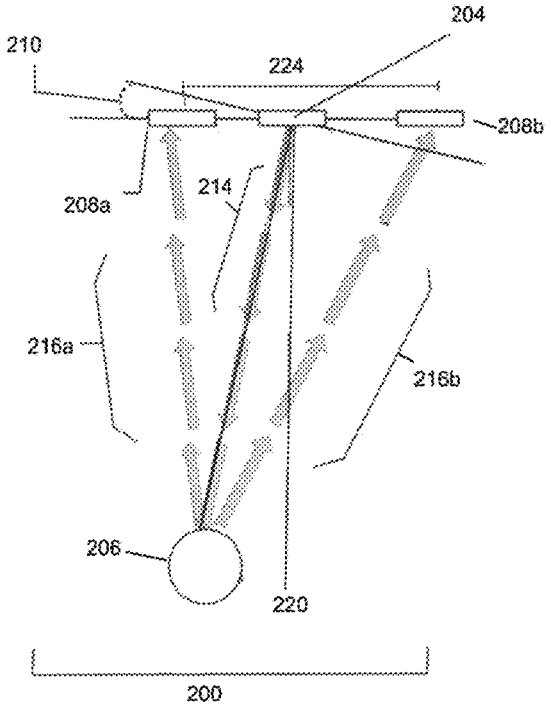
FIG. 2A is a conventional interferometer (CI) according to the principles of the present disclosure.
Figure 2B:
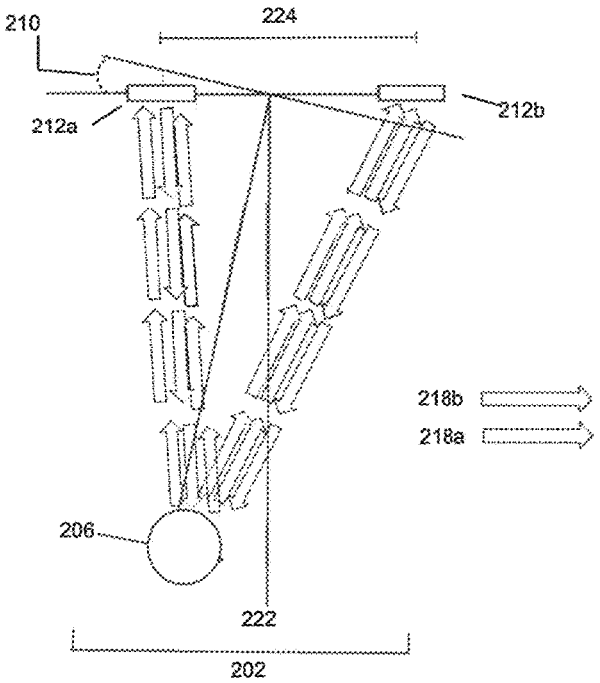
FIG. 2B is an orthogonal interferometer (OI) according to the principles of the present disclosure.

FIG. 2A and FIG. 2B compare the path lengths and system components of a conventional interferometer (CI) 200 and an Orthogonal Interferometer (OI) 202 for a notional two-dimensional case. For a CI measurement, a transmitter 204 illuminates the target 206 and the phase of the returns at two separate receivers 208*a*, 208*b* provides a differential path length difference ($\Delta\phi$), shown as 216*a*, and 216*b* that leads to a target angle estimate of $\theta$ 210. In the case of OI 202, two phase centers 212*a*, 212*b* each transmit orthogonal transmissions which are individually decorrelated on respective receptions. The fundamental concept behind the orthogonal interferometer is the use of at least two coherent transmit/receive antennas 212*a*, 212*b* that transmit nearly orthogonal coded waveforms. For example the orthogonal transmission from 212*a* travels to target 206 and returns to both transmit/receive antennas 212*a*, and 212*b*, this is shown by path 218*b*. Additionally an orthogonal transmission from 212*b* travels to target 206 and returns to both 212*a* and 212*b*, shown by path 218*b*. On reception, the separation of the signals is achieved by decoding against a particular code and exploiting the cross-correlation suppression of the orthogonal coded waveforms. Orthogonal coding in this sense can entail some combination of time, frequency and/or code modulation—as long as the receiver can perform a decorrelation and form an estimate of the received signal keyed to a particular transmit phase center.

As depicted the CI case 200 has a common transmit and distinct receive paths 216*a*, 216*b* while the OI case 202 has distinct transmit and receive paths 218*a*, 218*b* at each receiver 212*a*, 212*b*. Decoding OI has achieved a double path length dependency which provides twice the target angle 210 sensitivity as compared to CI with an equivalent SNR. The phase difference relationship of an interferometry is defined as $$\Delta\phi = K_\phi \frac{D}{2\pi\lambda}\sin(\theta);\ K_\phi = 1(CI),\ 2(OI)$$

where D is the interferometer baseline (array phase center separation), $\lambda$ is the nominal operating wavelength), and $K_\phi$ represents the phase gain factor that depends on path length. This expression highlights the physical advantage of a system with an electrically large baseline $$\left(\frac{D}{\lambda}\right)$$

in that it yields a greater $\Delta\phi$ for the same target offset $\theta$; the geometric "gain" of the larger interferometric baseline yields a larger $\Delta\phi$ relative to SNR dependent phase estimation noise $\sigma_{\Delta\phi}^2$ and provides a more precise measurement of $\theta$. In many signal processing applications the localized performance of an estimator can be bounded by the Cramer-Rao Lower Bound (CRLB). This bound on the $\theta$ estimation error for a CI radar or an OI radar is $$\sigma_\theta^{CI,OI} = \frac{\lambda}{K_\phi 2\pi D\sqrt{SNR}} K_\phi = 1(CI),\ 2(OI)$$

Note that for the same interferometer baseline (D) and same SNR the OI angle accuracy is a factor of 2 better than the CI angle accuracy.

Figure 2C:
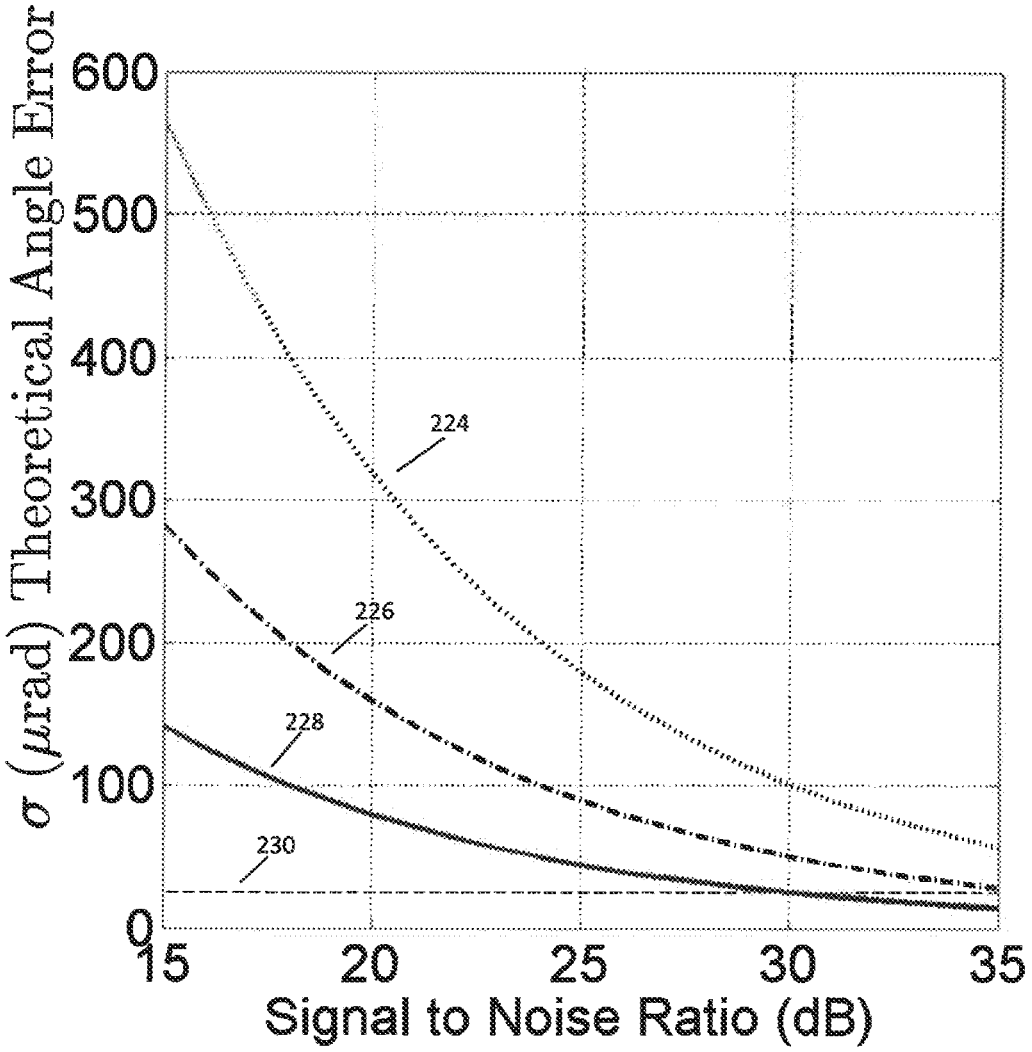
FIG. 2C shows the reduction in angle error with an OI compared to a CI with equivalent signal-to-noise ratio (SNR) according to the principles of the present disclosure.

FIG. 2C depicts the reduction in angle error with an OI compared to the CI with equivalent SNR; the OI radar achieves twice the precision (or the effective baseline) as compared to the CI radar. FIG. 2C compares CI case, D=50 $\lambda$ 224, and two OI cases, D=50 $\lambda$ 226, D=100 $\lambda$ 228 against with the ambitious angular precision goal $\sigma_\theta$=25 μrad, 230. It should also be noted that with respect to precision, a factor of two improvement in $\lambda$/D is worth a factor of four improvement in SNR.

This increase in the local precision of the angular estimate of $\theta$ due to an increased $$\frac{D}{\lambda}$$

comes at the cost of an increased chance of an ambiguous $\theta$ estimate. Angle ambiguity is a fundamental tradeoff that must be resolved for the potential of this increased estimator precision to have a real world benefit. There are a range of techniques used to suppress interferometer ambiguity. Depending on the particular application a combination of these techniques (discussed briefly herein) can provide effective angle disambiguation.

For interferometer baselines with D>>$\lambda$, $\Delta\phi$ can greatly exceed 2 $\pi$ so the determination of angle-of-arrival using phase difference $$\sin(\theta) = \frac{\lambda\Delta\phi}{4\pi D} + 2\pi N$$

will be ambiguous by N 2 $\pi$ wraps where N is the ambiguity number.

Figure 2D:
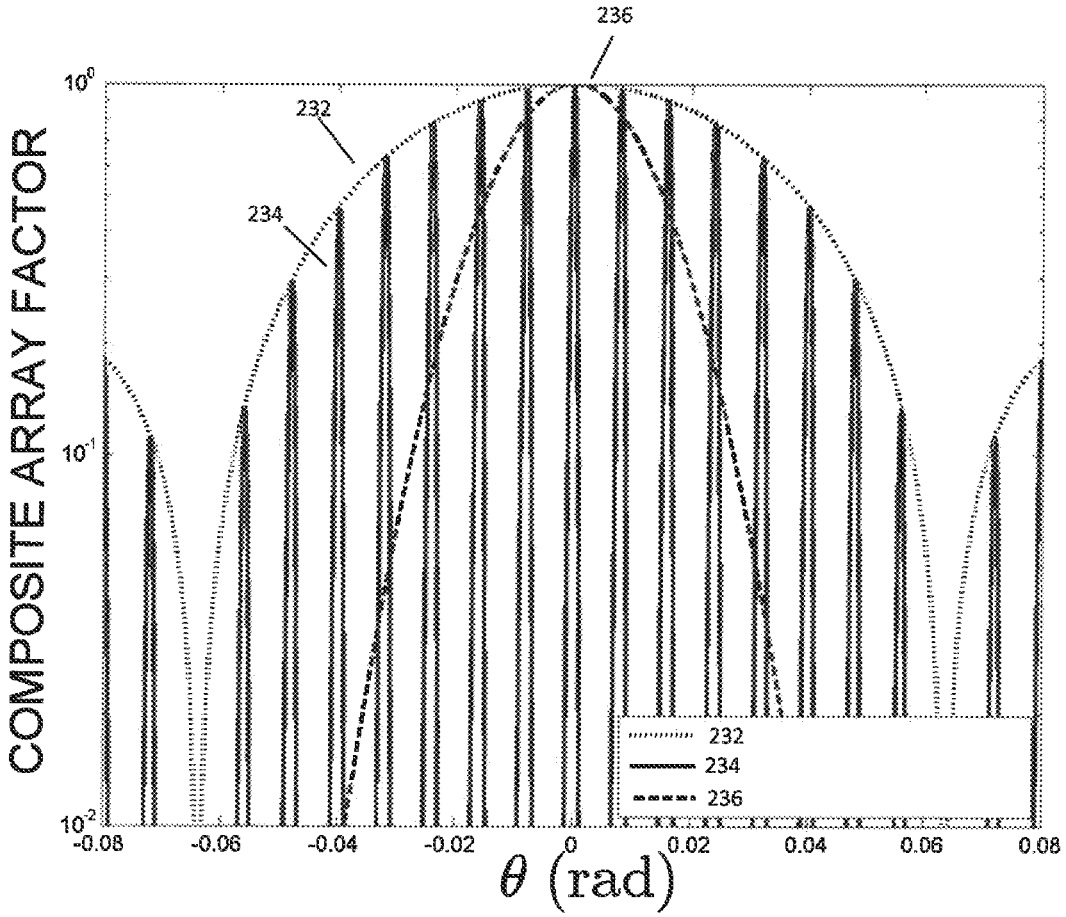
FIG. 2D shows a typical product of a real beam pattern and an electrically large interferometric ambiguity according to the principles of the present disclosure.
Figure 2F:
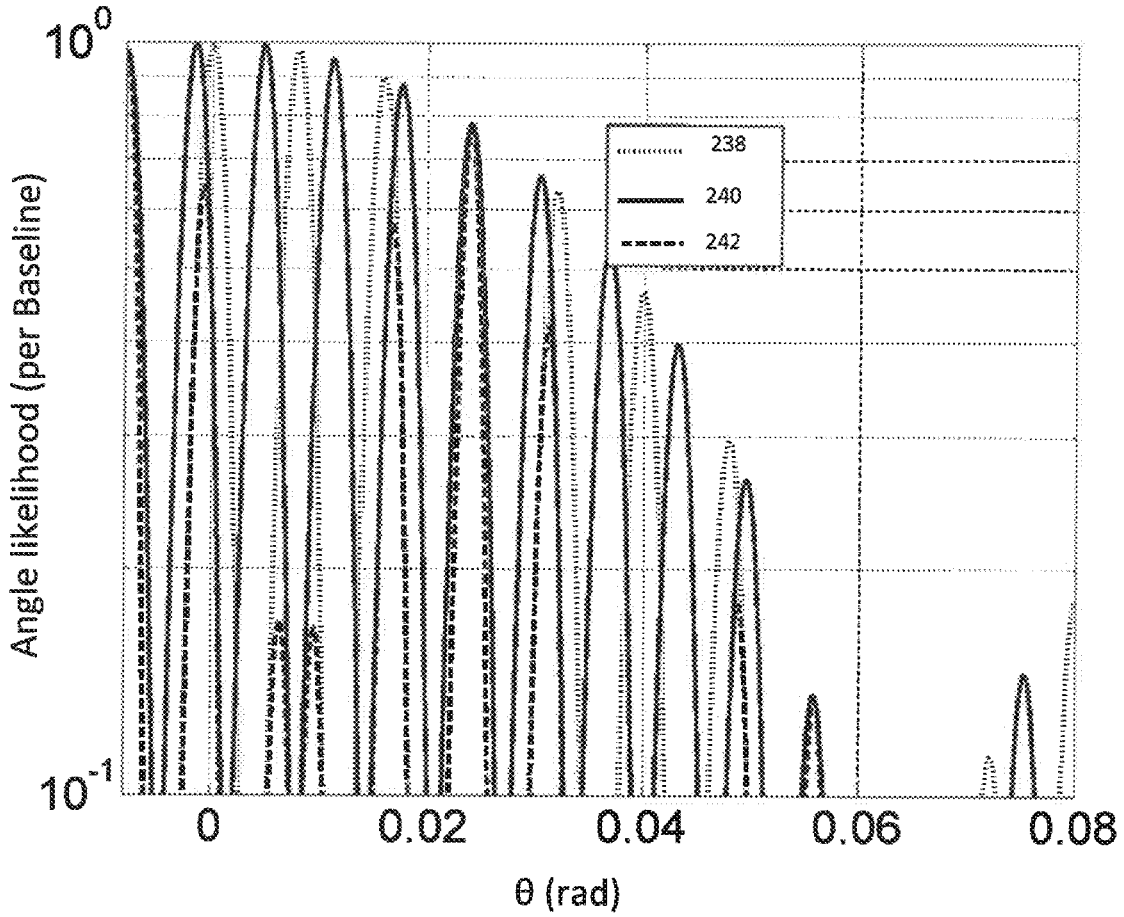
FIG. 2F shows the interaction of two lobe spacings whose product yields a substantial reduction in lobe amplitude according to the principles of the present disclosure.

FIG. 2D and FIG. 2E depict a typical product of a real beam pattern 232 and an electrically large interferometric ambiguity 234. Note that there are many closely spaced $$\frac{\lambda}{D}$$

lobes within the main lobe—all reflecting the same $\Delta\phi$ (modulo 2 $\pi$ measurement). Two important points should be taken from the "zoom" portion shown in FIG. 2E: First, $\sigma_\theta^{CI,OI}$, the angular precision of a local radius of a $$\frac{\lambda}{D}$$

lobe 234 trace is much finer than the physical beam pattern. Trying to disambiguate these closely spaced lobes based on a model of the amplitude difference from the main lobe's much broader response will require very high SNR and a highly consistent signal model that is unlikely to be available in a tactical system.

Still referring to FIG. 2D, the 236 trace represents a prior probability that would be part of a recursive tracking filter. CRLB is the radius of the local lobe. Trace 232 represents the array beam pattern and trace 234 represents the interferometer lobes. The figure shows large interferometer baselines D=100 $\lambda$ gain precision with increased ambiguity.

Another approach to ambiguity mitigation for the OI-tracer application would exploit the high prior information on the projectile trajectory, which provides the opportunity to incorporate accurate kinematic models. In this case, the 236 trace can be interpreted as a prior estimate in a non-linear estimation/tracking formulation where a specific $$\frac{\lambda}{D}$$

lobe's probability is updated via a Bayesian recursion and the local covariance is update via a Kalman Filter. A physical example of exploiting prior information would involve an OI radar with $$\frac{\lambda}{D} = \frac{1}{100}$$

or 1 meter at 100 m range which is still extremely coarse as compared to the "close-in" CEP of the projectile.

For a projectile guidance application, where all the projectiles are cooperative, and there are well timed targets, this approach would be naturally integrated into a tracking filter that can be incorporated the aero-ballistic modeling. A final approach to ambiguity suppression involves multiple measurements at distinct λ/D values forming multiple interferometric baselines. For each available λ/D baseline, the relationship among feasible ambiguity numbers scales (by λ/D) but since the true target angle θ is independent of $$\frac{\lambda}{D}$$

the unwrapped $0^{th}$ lobe experiences no shift.

FIG. 2E depicts (for θ=0) the interaction of two lobe spacings whose product yields a substantial reduction in lobe amplitude. Ambiguity can be suppressed by combining different $$\frac{\lambda}{D}$$

measurements.

$$\sin(\theta) = \frac{\lambda_1 \Delta\phi_1}{4\pi D_1} + 2\pi N_1 \text{ and } \sin(\theta) = \frac{\lambda_1 \Delta\phi_2}{4\pi D_2} + 2\pi N_2$$

This lobe-wise product will only admit an θ ambiguity where the two lobe spaces overlap closely; in the combination of $$\frac{\lambda}{D} = \frac{1}{125} 238$$

and of $$\frac{\lambda}{D} = \frac{1}{100} 240$$

or the 125/100 case, the first significant overlap 242 occurs at the $5^{th}$ $$\frac{\lambda}{D} = \frac{1}{125}$$

lobe and the $4^{th}$ $$\frac{\lambda}{D} = \frac{1}{100}$$

lobe. Hence, there is another ambiguity suppression approach that involves the projectile priors and the interferometer design. In sum, achieving very high precision angle and trajectory estimates via large baseline interferometry incurs the additional complexity of angle ambiguity. Successful mitigation of the ambiguity challenge in an operational system requires substantial integration of the interferometer, array, and aero-ballistic modeling—the details each depending on the particular system configuration under consideration.

In certain embodiments of the system of the present disclosure, the RF system via an orthogonal interferometry (OI) reference frame operates at a frequency of about 5-10 GHz and has a signal-to-noise ratio (SNR) of about 20 dB. In some embodiments, the antenna gain is about 15-20 dB. In some cases, the baseline is about 1.5 m with an angular precision of less than 1 mrad. In some cases, the angular accuracy is about 0.45 mrad. This accuracy is in contrast to conventional radar systems that have angular accuracy of about one to two degrees. Conventional radar systems are also limited by bandwidth. Additionally, radar has cross range accuracy at 100 km of about 2.5 km (1.5° beam width) as compared to a 45 m cross range accuracy for the RF/OI system disclosed herein. At 50 km, the present system has 22 m accuracy. This accuracy provides for accurate hand-off positioning. The present system provides actual location within GPS norms. In contrast, conventional radar systems produce a beam that is too broad to implement an angle transfer as described herein.

In some cases, the power requirement for the system ranges from about 100-200 W. The power needed is much lower than for a conventional radar system (e.g. 100 kW). Additionally, the RF/OI system is preferred due to inherent jamming resistance as compared to radar systems. In some embodiments, the projectiles have rear looking antennas for use with the RF/OI system. In some cases, the RF/OI illuminator can control multiple weapon batteries or UAV against multiple targets. The RF/OI reference frame is analogous to the localized GPS where several weapons platforms, air vehicles, and weapons can use the same RF/OI reference frame for navigation. In some cases, the pulse width for the system of the present disclosure is about 1.7 μsec which encapsulates the RF/OI waveform.

Figure 3:
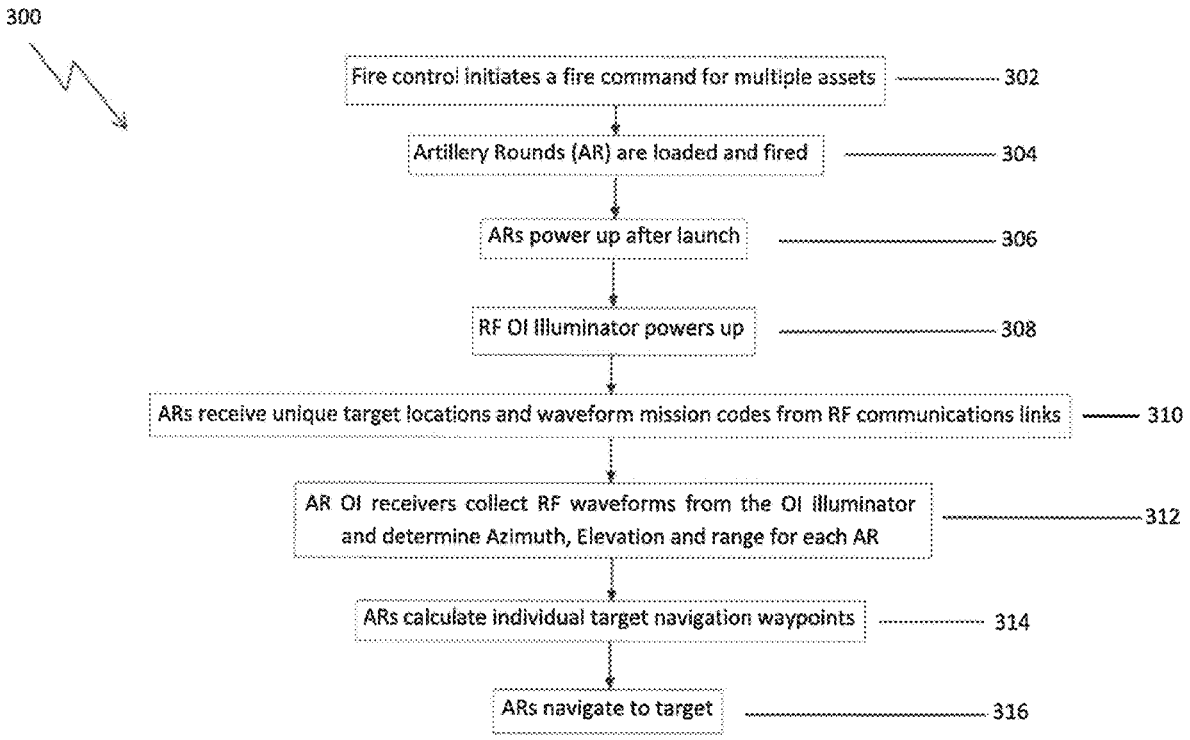
FIG. 3 is a flow chart of some of the functional elements for one embodiment of the system of the present disclosure.

Referring to FIG. 3, a flow chart 300 of some of the functional elements for one embodiment of the system of the present disclosure is shown. More specifically, in this embodiment, a fire control system initiates fire commands for multiple assets 302. In this case, the assets are artillery rounds (AR) or other munitions. In one example the ARs are then loaded and fired 304. The ARs are powered up after launch 306 or they may be active prior to launch to enable transfer of mission and target data. In some embodiments, the ARs have a rear-facing RF detector. In one example, the ARs have a communications module for receiving and/or transmitting information to a fire control system. In the example, the ARs have an on-board processor, memory, and/or additional detectors for use in guidance of the ARs to a target. In some cases, the RF/OI illuminator powers up after the launch of the ARs 308 or may be already powered-up if already in use. The ARs receive unique target information and waveform mission codes from RF communication links, or the like 310. The RF detectors on the ARs collect the RF/OI waveform data from the RF/OI illuminator and determine the azimuth, the elevation, along with the range information from each asset to the target 312. The ARs calculate target navigation waypoints 314 as each navigates to the target 316.

In some embodiments, multiple rounds are coordinated in one RF/OI reference frame. In some cases a full battery of Howitzers, or the like, are used and each round has customized trajectories for the particular target type or for masking the round's location. In some cases this is limited to the weapons control authority and its ability to fly an azimuth arc from the point of launch thereby disguising it's launch point from enemy counter fire radar.

In certain embodiments, the RF/OI reference frame is extended to about 100 km and provides location to within about 100 m. In some cases the reference frame is extended to about 50 km and provides location to within about 50 m. The system utilizes one way illumination with rear-looking antennas on the projectiles. The system of the present disclosure has RF jam hardening.

In some cases the round may be programmable during the initial flight path, which can reduce the time to fire. By equipping the RF/OI reference frame with a high quality north seeker, the system allows for "on the go" alignment for all of the rounds. No azimuth aiming is required with the RF/OI reference frame, and only minimal elevation adjustment is needed to account for a range differential. The RF/OI can be designed to cover various fields of engagement. In some cases, the field of engagement may be 10, 20 or 30 degrees.

The RF/OI method requires only minimal electronics costs embedded into each round, such as an RF receiver and RF apertures. In certain cases, the system transitions the guidance for the multiple rounds to a glide slope at about 6-10 km from the target. In some cases, the detonation for each AR is signaled by a fire control system. In some cases, detonation is signaled at a certain distance from the target. In some cases, detonation is signaled at a certain time or if the round is equipped with Height of Burst (HOB) sensor. In this application the rounds are being distributed in a grid pattern guided by the OI, the HOB is a standard fuse that measure its distance to ground and the end of the flight (last 15 seconds) to generate an air burst or ground, target dependent.

In one embodiment of the system of the present disclosure, a RF/OI precision guidance system is used to provide for counter swarm use, where a two-way RF/OI reference frame is used for flight management with a 10 to 20 round "in flight" capability. In some cases, this can be done with a continuous rate of fire of about 1-2 Hz. In certain embodiments, the RF/OI is also used for terminal guidance with a 200 μrad guidance loop.

In yet another embodiment of the system of the present disclosure, a RF/OI guidance system is used to provide for area suppression, where the RF/OI reference frame is used for flight management with an "in flight" capability of 6 to 10 rounds and the RF/OI system is used for terminal guidance with a 1 mrad guidance loop for area suppression.

In some cases, the RF/OI system has 5 GHz diversity at 100 steps—50 MHz each. This maintains a 200 MHz ADC sampling rate at a low cost. The RF/OI system has accuracy at a distance of 5 km of about ±5 m range, and ±1 mrad for azimuth and elevation. In certain embodiments, the RF system provides top cover flight management for about 85%-90% of the range to target and then transitions to a glide slope for the remaining 5 to 20 seconds prior to impact, depending on the initial target range and LOS limitation.

For sequential round control, the munitions receive the RF identification code for unique control of each round. The munition receives range codes for range calibration and determines the range by 1000 m to an accuracy of about ±3 m in the RF reference frame. The munition receives target OI position in the reference frame and its range from the munition. The munition confirms all instructions with fire control.

Figure 4:
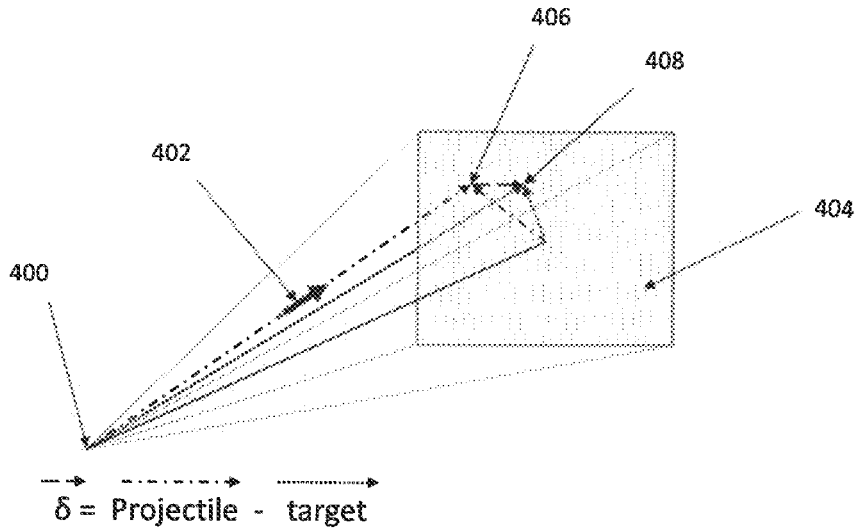
FIG. 4 is a diagram of one embodiment of the use of orthogonal interferometry to track a projectile and target in a reference frame.

Referring to FIG. 4, a diagram of one embodiment of the use of orthogonal interferometry to track a projectile and target in a partial reference frame is shown. More specifically, a projectile or munition 402 is fired from a launch area 400 and is tracked via an RF/OI reference frame 404 (partial view). The partial reference frame 404 is shown for convenience but normally resembles the reference frame shown in FIG. 1B. There are continuous updates for the current target location, which accounts for the OI frame structure motion, a moving target, and vehicle movement. Delta (δ) is determined by knowing the current location of the projectile versus the target angular location, which is decomposed into azimuth and elevation vectors. The bandwidth of one embodiment of the system is 200 Hz. The projectile OI coordinate 406 and the target OI coordinate 408 are shown. In one embodiment, the OI lines/bins are 11° by 7° FOC coverage, thus 11°*17.4/1=191 bins by 7°17.4/1=122 bins. The number of bins can be adjusted or larger or smaller FOVs may be used to provide the needed precision for the given application. These systems can be coupled together to provide additional FOV coverage with a simple temporal and frequency method and in theory provide for 360 degrees of coverage.

Figure 5:
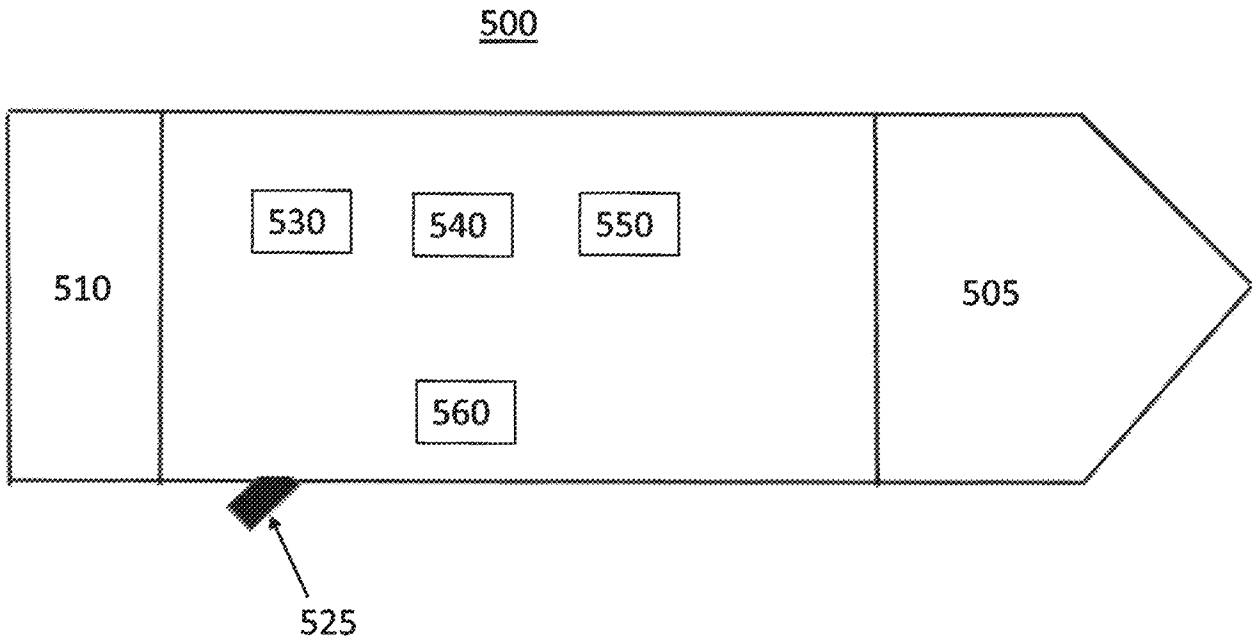
FIG. 5 is a depiction of the projectile according to one embodiment.

Referring to FIG. 5, a perspective view of the projectile 500 is shown that employs the RF/OI processing for navigation and guidance to the target. The projectile 500 can be a missile, rocket, artillery round or similar guided munition. The projectile has a front portion 505 that that typically houses the warhead and fuze elements such that the fuze detonates the warhead at the appropriate point for the desired result. On the rear or tail portion of the projectile 510 is an optional rocket engine that can be deployed to provide thrust to extend the range of the projectile and can be used to guide the projectile. In one example, the projectile is launched without a rocket engine such as from a launch platform that achieves a certain altitude and is guided to the target. Examples of launch platforms include anti-tank guns, mortars, howitzer, field guns and railguns. The projectiles from the launch platforms may or may not have a rocket engine.

Referring again to FIG. 5, the midsection tends to house the electronics, communications, and guidance/navigation systems. A rear facing antenna 525 is typically use to obtain the RF/OR waveforms for the reference frame that enable determination of the azimuth and elevation with respect to the illumination system. In one example, the processing involving firmware/software is performed on one or more processors that execute software residing on memory that is coupled to the processors. While labels are placed on certain items for descriptive purposes, the processing may be all done on a circuit card for have the processing technology. In this example an RF receiver 530 is coupled to the antenna 525. The RF receiver 530 has a downconversion stage to process the analog inputs from the antenna and may include mixer(s), filter(s) and low noise amplifier(s) to process the analog signals. The downconverted signals are input to an analog-to-digital converter (ADC) to provide digital information that is then processed by one or more processing units such as in a digital signal processor.

A short range guidance section 540 is used when the projectile reaches a hand-off point near the terminal end of the trajectory near the target area. The short range guidance section 540 in one example is a SAL seeker that receives a signal such as reflected laser signal from the target. Another example is an imaging section that uses a camera to view the target area and compares the captured image to stored images to identify the target and. In yet a further example, since the projectile is close to the target and was tracking to the target, an inertial measurement unit (IMU) can be used to keep the projectile in a proper orientation and path to the target.

A guidance, navigation and control section 550 is the digital processing section and is coupled to memory containing various instruction and routines and controls certain operation of the projectile. The signal processing of the OI includes decoding against a particular code and exploiting the cross-correlation suppression of the orthogonal coded waveforms. The azimuth and elevation data is obtained from the decoding. The RF communications such as the mission data and range data are also processed by the digital signal processor. Guidance information from the short range guidance section 540 is processed and control instructions are generated to direct the projectile to the target.

A control actuation system (CAS) 560 receives guidance controls and instructions to manipulate fins and canards (not shown) to steer the projectile. If the projectile has a rocket engine, that can also be employed to assist in reaching the target.

It will be appreciated from the above that portions of the invention may be implemented as computer software, which may be supplied on a storage medium or via a transmission medium. It is to be further understood that, because some of the constituent system components and method steps depicted in the accompanying Figures can be implemented in software, the actual connections between the systems components (or the process steps) may differ depending upon the manner in which the present invention is programmed. Given the teachings of the present invention provided herein, one of ordinary skill in the related art will be able to contemplate these and similar implementations or configurations of the present invention.

It is to be understood that the present invention can be implemented in various forms of hardware, software, firmware, special purpose processes, or a combination thereof. In one embodiment, the present invention can be implemented in software as an application program tangible embodied on a computer readable program storage device. The application program can be uploaded to, and executed by, a machine comprising any suitable architecture. The computer readable medium as described herein can be a data storage device, or unit such as a magnetic disk, magneto-optical disk, an optical disk, or a flash drive. Further, it will be appreciated that the term "memory" herein is intended to include various types of suitable data storage media, whether permanent or temporary, such as transitory electronic memories, non-transitory computer-readable medium and/or computer-writable medium.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A flight management system, comprising:

a radio frequency orthogonal interferometry array configured to generate a reference frame projected in the direction of one or more targets having radio frequency orthogonal interferometry waveforms and to further provide radio frequency (RF) communications;

at least one projectile configured to receive the radio frequency orthogonal interferometry waveforms and the RF communications;

a short range guidance system on the projectile configured to provide guidance of the projectile from a hand-off point to the targets; and a non-transitory computer-readable storage medium carried by the projectile having a set of instructions encoded thereon that when executed by one or more processors, provide guidance and navigation of the projectile, the set of instructions being configured to cause the one or more processors to perform:

processing azimuth and elevation information from the radio frequency orthogonal interferometry waveforms;

processing at least one of range information and mission data from the RF communications;

determining coordinates of the projectile using the azimuth, elevation and range information, wherein the coordinates are relative to the radio frequency orthogonal interferometry array;

guiding the projectile along a trajectory within the reference frame to the hand-off point;

switching to the short range guidance system at the hand-off point; and guiding the projectile from the hand-off point to the targets using a ballistic guidance or glide slope.

2. The flight management system of claim 1, wherein the at least one projectile is a plurality of projectiles and further comprising detonating the plurality of projectiles in a grid pattern in an area proximate the targets.

3. The flight management system of claim 1, wherein the radio frequency orthogonal interferometry array is aligned via a north finding device.

4. The flight management system of claim 1, further comprising processing a current projectile location and a target angular location decomposed into azimuth and elevation vectors, wherein the current projectile location is relative to the radio frequency orthogonal interferometry array.

5. The flight management system of claim 4, wherein at least one of the targets and the radio frequency orthogonal interferometry array are moving.

6. The flight management system of claim 1, wherein the at least one projectile is a plurality of projectiles and each projectile is sequentially transitioned from the reference frame to the glide slope.

7. The flight management system of claim 1, wherein each projectile is sequentially launched such that each projectile is sequentially transitioned from the reference frame to the glide slope for controlled detonation of a single target, multiple targets, or to a grid pattern.

8. A method of guiding multiple projectiles towards one or more targets, comprising:

receiving target locations and waveform mission codes via an RF communication link at each of the multiple projectiles;

collecting, via an radio frequency receiver located on each of the multiple projectiles, radio frequency waveforms from a radio frequency orthogonal interferometry array;

determining azimuth, elevation, and range to target data for each of the multiple projectiles, via an on-board processor;

calculating individual target navigation waypoints for each of the multiple projectiles via the on-board processor; and guiding each of the multiple projectiles to the one or more targets.

9. The method of claim 8, further comprising processing polar coordinates of the projectiles.

10. The method of claim 8, further comprising a short range guidance system for guiding the multiple projectiles to the one or more targets.

11. The method of claim 10, wherein the short range guidance systems is used for terminal guidance.

12. The method of claim 8, wherein at least one of the one or more targets and the radio frequency orthogonal interferometry array are moving and further comprising processing a current projectile location and a target angular location decomposed into azimuth and elevation vectors.

13. A computer program product including one or more non-transitory machine-readable mediums with instructions encoded thereon, that when executed by one or more processors cause a process for guidance and control of a plurality of projectiles to be carried out, the process comprising:

processing, via a radio frequency (RF) receiver on the projectiles, radio frequency orthogonal interferometry waveforms obtained from a reference frame, the reference frame being generated by a radio frequency orthogonal interferometry array;

receiving mission data and range information from radio frequency communications by the radio frequency orthogonal interferometry array;

determining, via an on-board processor, azimuth and elevation of the projectiles from the radio frequency orthogonal interferometry waveforms and further determining latitude and longitude of the projectiles using the range information;

calculating individual target navigation waypoints for a plurality of targets via the on-board processor; and guiding the projectiles to the targets.

14. The computer program product of claim 10, further comprising switching guidance of at least some of the projectiles to a short term guidance system at a hand-off point and guiding the projectiles to the target using the short term guidance system.

15. The computer program product of claim 10, further comprising detonating the projectiles proximate the targets.

* * * * *